United States Patent [19]

Mauldin

[11] Patent Number: 4,934,864

[45] Date of Patent: Jun. 19, 1990

[54] ASPHALT PAVER

[76] Inventor: Herbert N. Mauldin, 321 Viewmont Dr., Greenville, S.C. 29609

[21] Appl. No.: 281,663

[22] Filed: Dec. 9, 1988

[51] Int. Cl.[5] ..... E01C 19/18

[52] U.S. Cl. ..... 404/108; 404/101; 404/84; 280/111

[58] Field of Search ..... 404/101, 108, 83, 84; 280/111

[56] References Cited

U.S. PATENT DOCUMENTS

| | | | |
|---|---|---|---|
| 2,589,256 | 3/1952 | Horning | 404/83 |
| 3,037,470 | 6/1962 | Watson et al. | 280/111 |
| 3,054,334 | 9/1962 | Barber | 404/108 |
| 3,259,034 | 7/1966 | Davin | 404/83 |
| 3,481,421 | 12/1969 | Sullivan | 280/111 |
| 3,506,079 | 4/1970 | Madler et al. | 280/111 |
| 3,783,966 | 1/1974 | Campbell et al. | 280/111 |
| 3,890,055 | 6/1975 | Rochfort | 404/84 |
| 4,152,004 | 5/1979 | Schroder | 280/111 |
| 4,332,505 | 6/1982 | Mauldin | 404/108 |
| 4,801,218 | 1/1989 | Musil | 404/84 |

*Primary Examiner*—Jerome W. Massie, IV
*Assistant Examiner*—Gay Ann Spahn
*Attorney, Agent, or Firm*—Bailey & Hardaway

[57] ABSTRACT

An asphalt paver is illustrated having a hopper carried by a rigid longitudinal frame upon which is mounted a transversely oscillatable frame carrying wheels intermediate the hopper and a rearwardly positioned screed.

9 Claims, 4 Drawing Sheets

ASPHALT PAVER

BACKGROUND OF THE INVENTION

A paver having a screed receiving asphalt on a conveyor from a hopper is illustrated in U.S. Pat. No. 4,332,505. Asphalt pavers in accordance with the prior art which have large wheels, fixed to a frame between a hopper and screed, are incapable of following irregularities in the terrain being traversed during paving and transporting due to fixed mounting of the wheels. Such a mounting may result in one of the opposite wheels coming off the ground entirely if the irregularities are sufficiently pronounced. The use of transversely aligned wheel carrying frames each of which pivoted about a longitudinal axis for dividing a load resulting from irregularities in the terrain traversed by a planting machine is illustrated in U.S. Pat. No. 3,037,470.

Accordingly, it is an important object of this invention to provide a paver having large wheels which follow irregularities in the terrain and remain in contact with the ground for supporting a load equally between the wheels. This is accomplished by providing an asphalt paver with a transversely oscillatable mounting for the wheels.

It is another important object of the invention to provide a transverse oscillatory wheel mounting which supports a load equally between wheels despite irregularities in terrain being traversed and which permits asphalt to be fed beneath the wheel mounting.

Another important object of the invention is to provide a mounting for carrying wheels for transverse oscillatory movement intermediate a hopper and screed with independent driving means for the wheels carried upon the transverse oscillatory mounting.

Another object of the invention is the provision of steering wheels for an asphalt paver beneath and supporting a hopper but which may be remotely controlled adjacent the screed while providing intermediate support wheels with a means for balancing a load between them.

An important object of this invention is the provision of a longitudinal king pin for mounting wheels of a paver and the like for transverse oscillatory movement in unison during paving and transport.

SUMMARY OF THE INVENTION

It has been found that an independent oscillatory mounting may be provided for large load bearing wheels of an asphalt paver above a rigid longitudinal frame and above a conveyor for carrying asphalt therebeneath from the hopper to the screed with means for positioning independent wheel drives thereon. Steering wheels are carried beneath the hopper and operating means is positioned remotely adjacent the screed.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
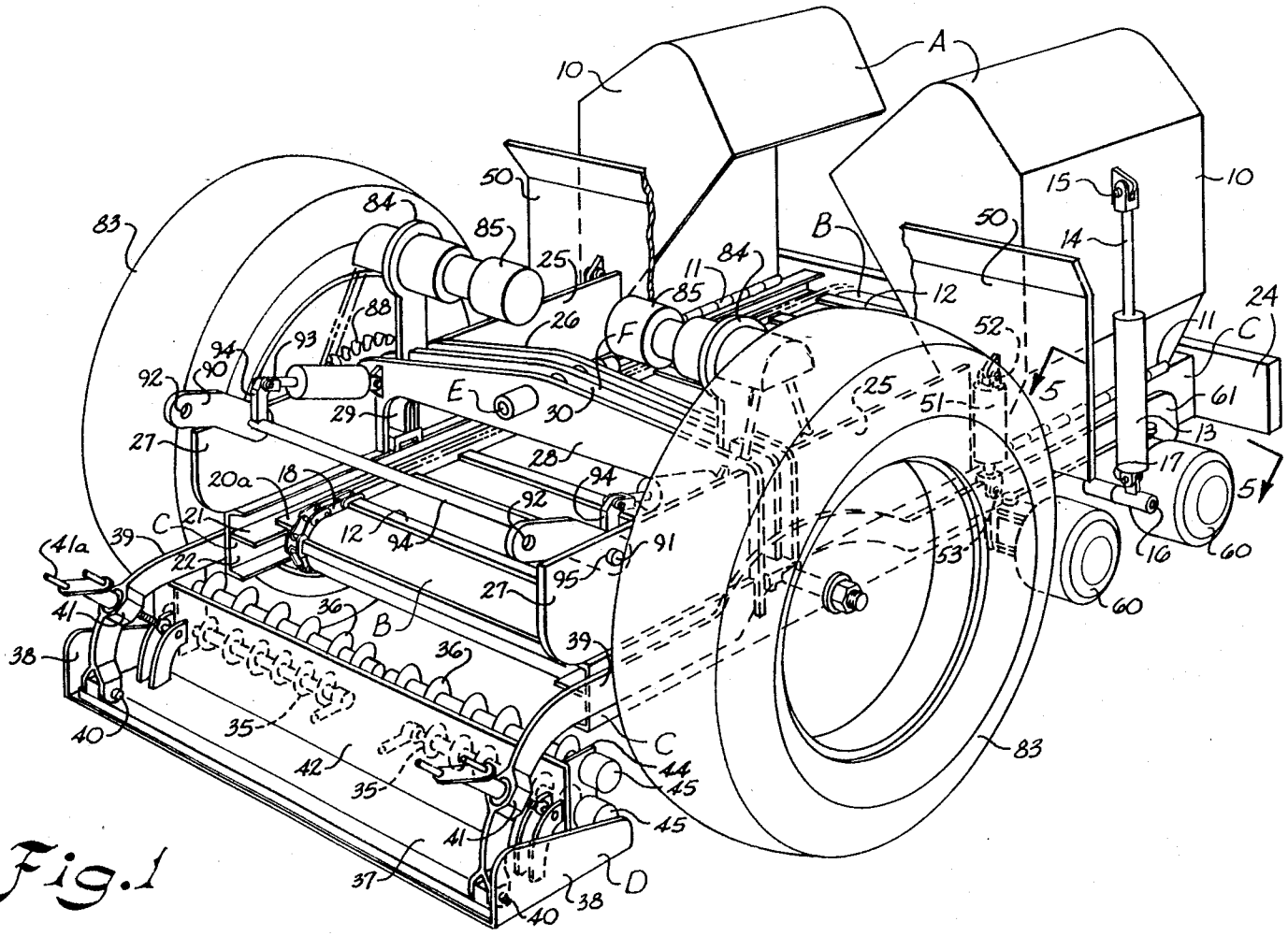
FIG. 1 is a perspective view illustrating a paver constructed in accordance with the invention having a rigid longitudinal frame carrying transversely oscillatable supporting wheels intermediate a hopper and screed.

The drawings illustrate an asphalt paver having a hopper A for receiving asphalt. A power operated conveyor B feeds asphalt from the hopper longitudinally rearwardly of the paver. A rigid longitudinal frame C carries the hopper in fixed relation adjacent a front end. A screed D is carried rearwardly of the paver having a connection to the rigid longitudinal frame for smoothing asphalt fed by the conveyor. A king pin E is carried above the rigid longitudinal frame in longitudinal alignment centrally of the rigid longitudinal frame and the hopper and screed. A transverse yoke F is carried by the king pin for pivotal movement transversely of the rigid longitudinal frame. Driven wheels are carried adjacent respective ends of the yoke for movement independently of the frame responsive to irregularities in the surface traversed during paving.

Referring more particularly to the drawings, the hopper A consists essentially of opposed receiving members 10 each of which are mounted on hinges 11 to one of the channel members forming the longitudinal frame C. The flights 12 of the upper longitudinal run of the conveyor B serve as a bottom for the hopper A. The receiving members 10 may be opened more fully than illustrated in FIG. 1 by action of the cylinders 13. The cylinders 13 have an extensible member 14 pivotally connected as at 15 to an upper portion of the receiving members 10. A hub 16 carries a lower end of the cylinders 13 which is pivotally connected thereto as at 17.

Figure 6:
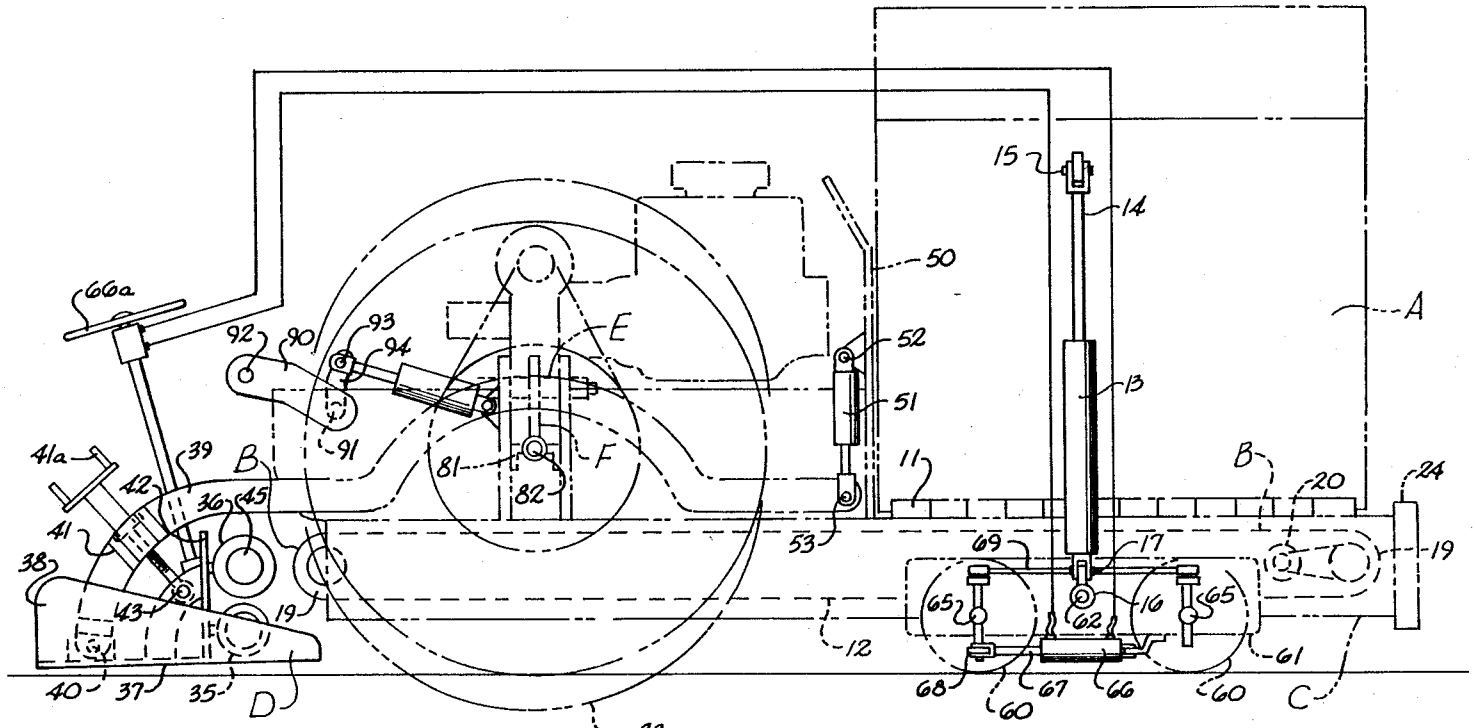
FIG. 6 is a schematic side elevation illustrating a paver constructed in accordance with the present invention showing the flow of asphalt from the hopper beneath the wheel mounting to the screed.

The conveyor B may be similar to that shown in greater detail in U.S. Pat. No. 4,332,505. The conveyor has a number of flights 12 carried by chains 18 on each side thereof. The chains have a sprocket 19 (FIGS. 2 and 6) at each end of a frame 20. The sprockets are driven by a suitable motor 21 (FIG. 6). The frame 20 has a pair of longitudinally aligned angle members having opposed horizontal legs **20*a* carried upon a shelf 21 which is suitably secured as by welding to the webs 22 of the longitudinal frame members C intermediate the in turned flanges 23**.

A transverse bridging member 24 has rigid attachment to the longitudinal frame members 22 at the forward ends thereof. The longitudinal frame members, in addition to the channel members 22, include opposed upstanding frame members 25 each of which is suitably secured to the upper web of respective longitudinal frame members 22. A bridging member generally in the shape of a harness or yoke is illustrated at 26 and joins inner ends of upstanding members 25 bridging the channel members 22. Similar upstanding frame members 27 are provided adjacent the rear of the longitudinal frame members 22 and are rigidly secured thereto as by welding. The inner ends of the upstanding members 27 are joined as by the fixed yoke 28. A slot 29 is thus formed between the yokes 26 and 28 which act as a support for accommodating a pivotally mounted intermediate yoke portion 30 carried therebetween. The yoke portion 30 has intermediate hubs 31 (FIG. 3) on each side thereof and such is positioned upon a sleeve 32 carried by a king pin E.

A suitable screed D such as illustrated in U.S. Pat. No. 4,332,505 is illustrated at D, and an auger means similar to that disclosed in U.S. Pat. No. 4,527,649 may be utilized for spreading the asphalt received from the conveyor prior to smoothing by the screed. As illustrated in FIGS. 1 and 6 a pair of opposed driven lower augers are illustrated at 35, and a pair of opposed larger superposed augers are illustrated at 36.

The screed D includes a lower plate 37 which is illustrated as being tilted upwardly slightly as best shown in FIG. 6 as during paving. The end plates 38 are provided for pivotally carrying the longitudinal support arms 39 as at 40. The arms 39 have internally threaded members 41 for adjustably positioning the tilt angle of the plate 47 by turning the crank **41*a* which has a threaded member having pivotal connection as at 43 to pivotally adjust the plate 37. A vertical plate 42 has fixed connection with the plate 37. It will be noted that the lower augers 35 are carried by suitable mounting plates 44 on the front side of the vertical plates 42 and are driven by motors 45. The upper superposed augers are also carried by the mounting plates 44 and are driven by the motors 45**.

Referring more particularly to FIG. 1, it will be noted that the upstanding plate 50 extends transversely of the paver and forms a bridging member across the frame C as well as an end receiving member for the hopper when the receiving members 10 are open. The frame member 50 carries a fluid motor 51 having a pivotal connection on one end to the plate 50 as at 52 and on an end of the support arms 39 as at 53 for adjusting the screed to govern the depth of the asphalt.

Figure 5:
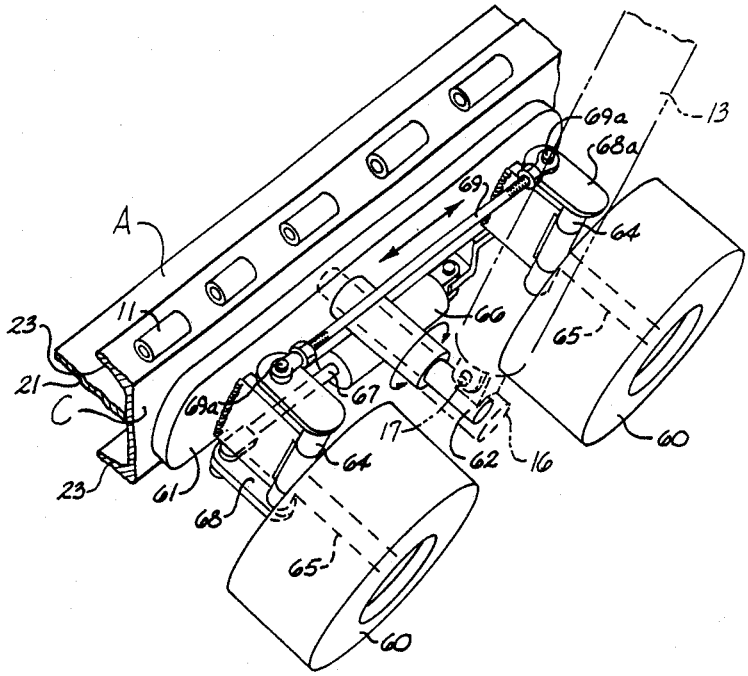
FIG. 5 is a perspective view taken on the line 5—5 in FIG. 1, illustrating a driving arrangement for the steering wheels supporting the hopper.
Figure 4:
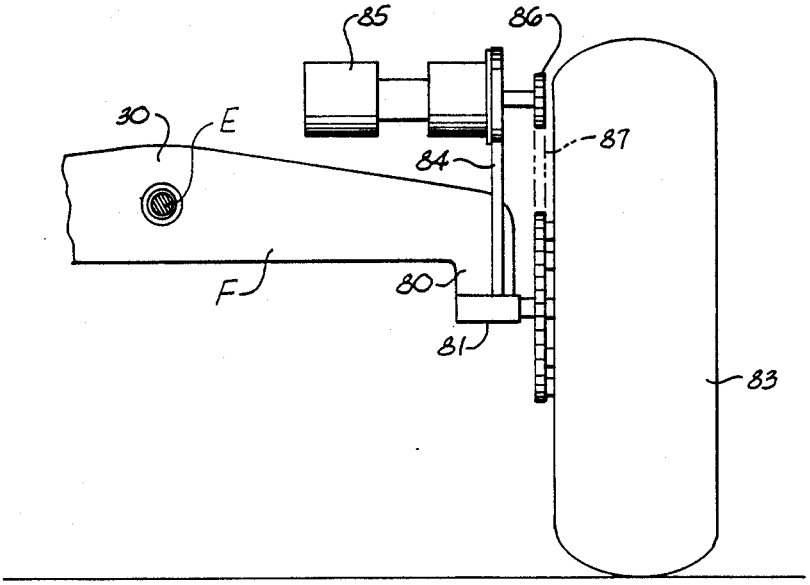
FIG. 4 is a transverse sectional elevation taken on the line 4—4 in FIG. 2 illustrating a wheel mounting and drive.

Suitable steering means is provided for the paver which includes pairs of front wheels 60 on each side of the paver as illustrated in FIG. 1, 5 and 6. The front wheels 60 are illustrated as being carried by a longitudinal frame member 61 which has pivotal connection to the frame C as by the stub shaft 62 (FIGS. 5 and 6) upon which the hub 16 is mounted. The stub shaft acts as a pivot point for oscillatory movement for the longitudinal frame 61. The frame 61 carries suitable mountings 63 for vertical shafts 64 upon which the wheel axles 65 are mounted. The cylinder 66 has an extensible piston rod 67 which has pivotable connection on one end of a link 68. The other end of the link is connected to the shaft 64 which operates the link 68 (FIGS. 5 and 6) to oscillate the tie rod 69 back and forth to move corresponding linkage **68*a* for moving the front wheel of the pair of wheels 60** together.

The cylinder 66 is operated to steer the wheels through suitable lines operated by moving the steering wheel **66*a* carried as illustrated in FIG. 6**.

The tie rod 69 has pivotal connection at each end as at **69*a* with the links 68 and 68*a* respectively. The transverse yoke F having the intermediate hub carrying portion 30 is carried upon the king pin E intermediate the fixed yoke members 26 and 28. The yoke member F has enlarged intermediate members which taper inwardly toward their ends where downturned members 80 have blocks 81 adjacent their ends for carrying fixed shafts 82 upon which the enlarged inflatable wheels 83 are mounted. The blocks 81 move up and down in the slots 29 between the fixed yokes 26 and 28** when the yoke F is oscillated upon the king pin E.

Each of the blocks 81 carries a vertical support 84 thereon upon which is positioned an independently driven motor 85 for driving a sprocket 86 and in turn a chain 87. The chain 87 drives the respective sprockets 88 which drive the respective wheels 83.

The yoke F which is oscillatably mounted upon the king pin serves the unique function of permitting the intermediate wheels of the paver between the hopper and the screed to accommodate themselves to distribute their load as may be imposed by the contours and irregularities of the terrain being traversed during paving and during transport.

Figures 2, 3:
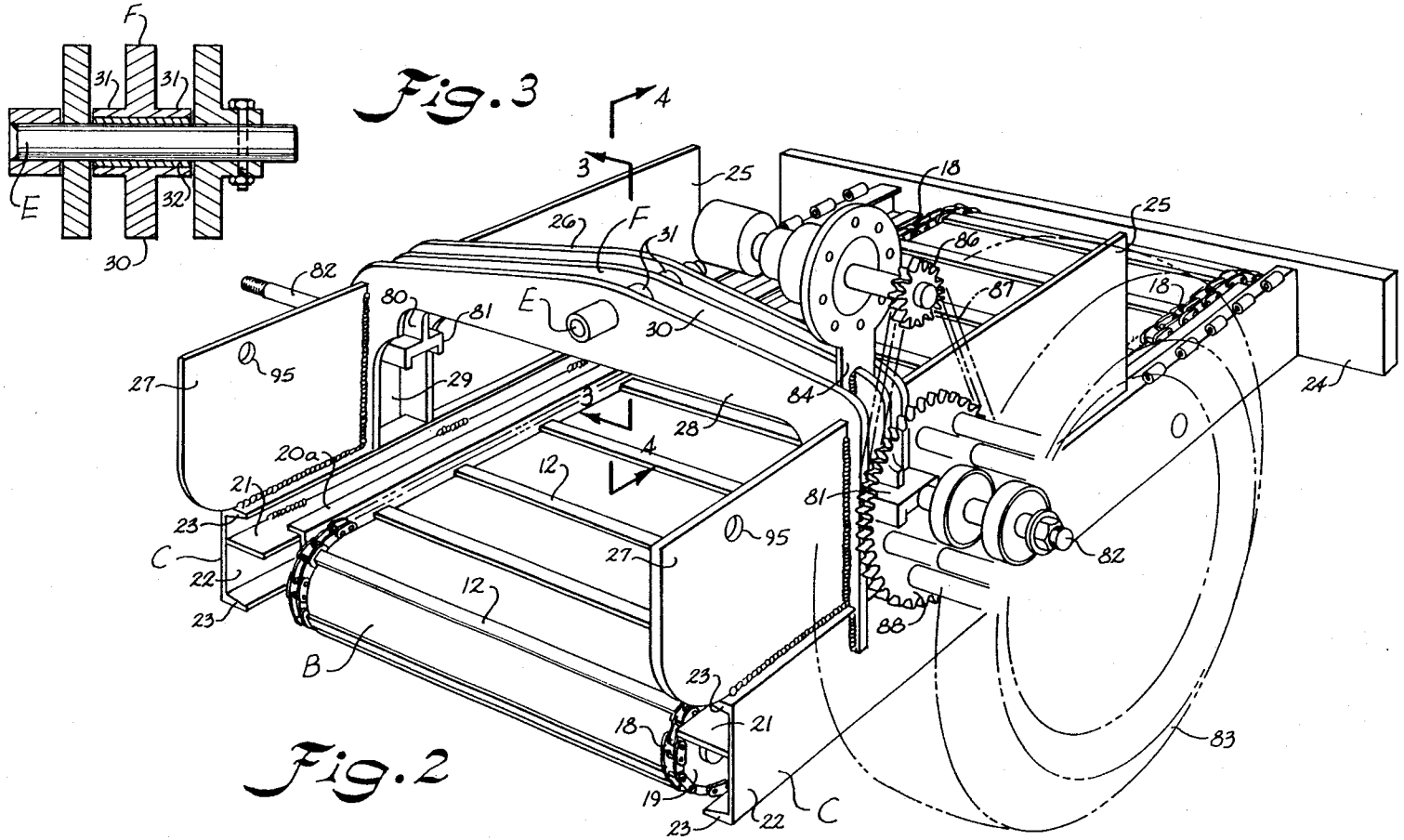
FIG. 2 is an enlarged perspective view similar to FIG. 1 illustrating details of an oscillatory mounting and wheel driving means.
FIG. 3 is a longitudinal sectional elevation taken on the line 3—3 in FIG. 2 illustrating an oscillatory mounting for the wheels including a king pin.

While the cylinders 51 control positioning of the screed as to thickness of the paved surface during transport, it is necessary to raise the screed by providing a lifting action and a support adjacent the downwardly curving portion of the arms at **39*a*. This may be accomplished by attaching the respective links 90 which are pivoted as at 91 by passing a chain (not shown) about respective arms 39 adjacent the screed and utilizing a suitable hook (not shown) to engage the hole 92 in the free ends of the respective links 90. Suitable cylinders have extensible members pivotally connected as at 93 to the upright links 94. The pivoted ends 91 of the crossbar 94*a* (FIG. 1) are pivotally carried within the vertical plates 27 within the openings 95 (FIG. 2**).

While a preferred embodiment of the invention has been described using specific terms, such description is for illustrative purposes only, and it is to be understood that changes and variations may be made without departing from the spirit or scope of the following claims.

What is claimed is:

1. An asphalt paver comprising:

a hopper for receiving asphalt;

a power operated conveyor feeding asphalt from said hopper longitudinally rearwardly of said paver;

a rigid longitudinal frame carrying said hopper in fixed relation thereto adjacent a front end thereof and carrying said conveyor for feeding asphalt from said hopper longitudinally rearwardly of said paver;

a screed carried rearwardly of said paver connected to said rigid longitudinal frame for smoothing asphalt fed thereto by said conveyor;

a mounting positioned above said rigid longitudinal frame between said hopper and said screed;

a rigid transverse frame extending across said rigid longitudinal frame carried by said mounting for transverse, oscillatable movement of said transverse frame on said mounting about an intermediate portion of said rigid longitudinal frame;

said power operated conveyor extending longitudinally beneath said transverse frame for delivering asphalt from said hopper to said screed; and driven wheels carried adjacent respective ends of said transverse frame on each side of said rigid longitudinal frame for movement independently of said longitudinal frame responsive to irregularities in the surface traversed during paving.

2. The structure set forth in claim 1 including second wheels carried by said frame beneath said hopper, and power operated means turning said second wheels, said power operated means being controlled independently of and rearwardly remote from said driven wheels.

3. The structure set forth in claim 1 including a rigid support frame extending upwardly from said rigid longitudinal frame, said support frame including longitudinally spaced transverse members bridged longitudinally by a king pin forming said mounting, wherein said transverse frame is a yoke pivotally carried by said king pin between said spaced transverse members for said oscillatable movement.

4. The structure set forth in claim 1 including a pair of ledge members extending inwardly in opposed relation fixed within said rigid longitudinal frame supporting an upper run of said conveyor and driven augers for spreading asphalt received from said conveyor preparatory to smoothing by said screed.

5. The structure set forth in claim 3 including a wheel drive motor carried by said yoke on each side of said king pin for independently driving a respective wheel.

6. A paver comprising:

an elongated rigid longitudinal frame;

a rigid wheel carrying frame extending transversely of said longitudinal frame across said paver;

a pivotal mounting for said wheel carrying frame having rigid connection to said longitudinal frame in a central portion thereof; and a support for positioning said pivotal mounting above said longitudinal frame.

7. The structure set forth in claim 6 wherein said pivotal mounting includes a longitudinal king pin carried above said longitudinal frame, wherein said transverse frame is a yoke, and including a conveyor having an upper longitudinal run extending beneath said yoke.

8. An asphalt paver comprising:

a hopper for receiving asphalt;

a power operated conveyor feeding asphalt from said hopper longitudinally rearwardly of said paver;

a rigid longitudinal frame carrying said hopper in fixed relation adjacent a front end thereof;

a screed carried rearwardly of said paver having connection to said rigid longitudinal frame for smoothing asphalt fed thereto by said conveyor;

a king pin carried above said rigid longitudinal frame in fixed relation thereto and in longitudinal alignment centrally of said rigid longitudinal frame and said hopper and screed carried thereby;

a transverse yoke carried by said king pin for pivotal movement transversely of said rigid longitudinal frame; and driven wheels carried adjacent respective ends of said yoke for movement independently of said frame responsive to irregularities in the surface traversed during paving.

9. The structure set forth in claim 8 including a rigid frame fixed to and extending upwardly from said rigid longitudinal frame supporting said king pin in a central portion thereof.

* * * * *